US009366218B2

(12) United States Patent
Takeshige et al.

(10) Patent No.: US 9,366,218 B2
(45) Date of Patent: Jun. 14, 2016

(54) IGNITION DEVICE FOR BATTERY-LESS ENGINE AND METHOD FOR STARTING AND OPERATING BATTERY-LESS ENGINE

(71) Applicant: HONDA MOTOR CO., LTD., Tokyo (JP)

(72) Inventors: Takamasa Takeshige, Wako (JP); Keiichiro Bungo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 344 days.

(21) Appl. No.: 13/967,592

(22) Filed: Aug. 15, 2013

(65) Prior Publication Data

US 2014/0053820 A1 Feb. 27, 2014

(30) Foreign Application Priority Data

Aug. 27, 2012 (JP) ..... 2012-186567

(51) Int. Cl.
*F02P 1/08* (2006.01)
*F02N 11/08* (2006.01)
(Continued)

(52) U.S. Cl.
CPC . *F02P 1/04* (2013.01); *F02P 1/083* (2013.01); *F02N 3/02* (2013.01); *F02N 11/0848* (2013.01); *F02P 15/12* (2013.01); *F02P 2017/121* (2013.01)

(58) Field of Classification Search
CPC ..... F02P 1/04; F02P 1/083; F02P 1/00; F02P 3/01; F02P 3/045; F02P 3/05; F02P 9/002; F02P 15/12; F02N 3/02; F02N 11/087; F02N 2011/0892; F02N 2200/022
USPC ..... 123/606, 617, 609, 599, 605
See application file for complete search history.

(56) References Cited

U.S. PATENT DOCUMENTS 4,043,302 A 8/1977 Sessions
4,441,479 A * 4/1984 Endo ..... F02P 3/0884 123/143 B (Continued)

FOREIGN PATENT DOCUMENTS

DE 10201422 3/2003
EP 2031218 3/2009

(Continued)

OTHER PUBLICATIONS

European Search Report , Application No. EP 13179661, dated Jan. 29, 2014, 2 pages.

(Continued)

*Primary Examiner* — Lindsay Low
*Assistant Examiner* — George Jin
(74) *Attorney, Agent, or Firm* — Rankin, Hill & Clark LLP

(57) ABSTRACT

In the ignition device for the battery-less engine, a transistor-type ignition control circuit of the engine including a manual starting device is actuated by using output of the generator driven by the engine, and a primary winding of an ignition coil is powered from the ignition control circuit. In the ignition control circuit, a primary powering time period for powering the primary winding from the ignition control circuit is set shorter than a predetermined time period while an engine speed of the engine is within a low engine speed range below a predetermined engine speed, whereas the primary powering time period is set equal to or longer than the predetermined time period while the engine speed of the engine is within a high engine speed range at and above the predetermined engine speed.

4 Claims, 5 Drawing Sheets

(51) Int. Cl.

| | |
|---|---|
| ***F02P 1/04*** | (2006.01) |
| *F02N 3/02* | (2006.01) |
| *F02P 15/12* | (2006.01) |
| *F02P 17/12* | (2006.01) |

(56) References Cited

U.S. PATENT DOCUMENTS

| | | | | |
|---|---|---|---|---|
| 4,625,689 | A | 12/1986 | Komurasaki | |
| 5,245,252 | A * | 9/1993 | Frus | F02P 3/0869 123/634 |
| 5,383,433 | A * | 1/1995 | Fiorenza, II | F02P 5/1506 123/335 |
| 5,553,594 | A * | 9/1996 | Ehlers | F02P 3/0456 123/609 |
| 5,762,052 | A * | 6/1998 | Minkov | F02P 15/12 123/607 |
| 5,778,862 | A | 7/1998 | Fukui | |
| 6,058,908 | A * | 5/2000 | Masters | F02P 7/07 123/406.59 |
| 6,932,064 | B1 * | 8/2005 | Kolak | F02P 1/083 123/594 |
| 7,686,000 | B2 * | 3/2010 | Garrard | F02P 3/053 123/609 |
| 2005/0205073 | A1 * | 9/2005 | Fuller | F02P 3/06 123/599 |
| 2009/0012699 | A1 * | 1/2009 | Bahner | F02D 41/2422 701/105 |
| 2011/0056451 | A1 * | 3/2011 | Geyer | F02D 41/062 123/179.16 |
| 2011/0146611 | A1 * | 6/2011 | Gorenflo | F02P 1/086 123/179.28 |
| 2012/0160222 | A1 * | 6/2012 | Grady | F02P 3/04 123/622 |

FOREIGN PATENT DOCUMENTS

| | | |
|---|---|---|
| GB | 2141483 | 12/1984 |
| JP | S58-133475 A | 8/1983 |
| JP | 59-47366 U | 3/1984 |
| JP | 2518904 | 9/1996 |
| JP | H10-220330 A | 8/1998 |
| JP | 2012-136965 A | 7/2012 |

OTHER PUBLICATIONS

Japanese Office Action dated Aug. 19, 2015, 3 pages.

* cited by examiner

IGNITION DEVICE FOR BATTERY-LESS ENGINE AND METHOD FOR STARTING AND OPERATING BATTERY-LESS ENGINE

CROSS-REFERENCE TO RELATED APPLICATIONS

The present application claims priority under 35 USC 119 to Japanese Patent Application No. 2012-186567 filed on Aug. 27, 2012 the entire contents of which are hereby incorporated by reference.

BACKGROUND OF THE INVENTION

1. Field of the Invention

The present invention relates to an ignition device for a battery-less engine configured such that a transistor-type ignition control circuit of an engine including a manual starting device and equipped with no battery is actuated by using output of a generator driven by the engine, and that a primary winding of an ignition coil is powered from the ignition control circuit. The invention also relates to an associated method.

2. Description of the Related Art

An ignition device for an engine configured such that an ignition control circuit is actuated by using output of a generator driven by a battery-less engine including a manual starting device has conventionally been known, as disclosed in Japanese Utility Model Registration No. 2518904.

SUMMARY OF THE INVENTION

As shown in FIG. 3, required secondary voltage V2 of such an ignition device is generally low (V2L) while the engine speed is low relative to a predetermined value N2 and high (V2H) while the engine speed is high relative to the predetermined value N2, due to a correlation between the required secondary voltage V2 and compression pressure in the engine. Moreover, in the case of employing a transistor-type ignition control circuit, increasing a primary powering time period T is followed by increases of primary current I to IL and to IH, and in response thereto, the secondary voltage V2 increases to V2L and to V2H.

Meanwhile, in a conventional ignition device for an engine equipped with a battery, secondary voltage is outputted by setting a primary powering time period that matches required secondary voltage during high speed engine rotations. Now assume that this technique is applied as is to a battery-less engine. In this case, when the engine is cranked through a manual starting operation, it would be difficult for the generator to generate power that is large enough to cover the amount of power required by both the power supply system and the ignition control system. This leads to unstable actuation of the ignition control system.

To solve this problem, the generator needs a large-capacity magneto coil capable of generating a sufficient amount of power from when the engine speed is low. This results in increase in the size of the generator, which is disadvantageous in terms of cost.

The present invention has been made in view of the above circumstances, and an object thereof is to provide an ignition device for a battery-less engine capable of securely performing ignition of the battery-less engine from a state where the engine is started through a manual starting operation to a state where the engine in a high engine speed range, without particularly increasing the capacity of a magneto coil of a generator.

In order to achieve the object, according to a first aspect of the present invention, an ignition device for a battery-less engine is configured such that a transistor-type ignition control circuit of an engine including a manual starting device is actuated by using output of a generator driven by the engine, and that a primary winding of an ignition coil is powered from the ignition control circuit. The ignition control circuit is configured such that a primary powering time period for powering the primary winding from the ignition control circuit is set shorter than a predetermined time period while an engine speed of the engine is within a low engine speed range below a predetermined engine speed and the primary powering time period is set equal to or longer than the predetermined time period while the engine speed of the engine is within a high engine speed range at and above the predetermined engine speed.

According to the first aspect of the present invention, the primary powering time period for powering the primary winding from the ignition control circuit is set shorter than the predetermined time period while the engine speed is within the low engine speed range below the predetermined engine speed. On the other hand, the primary powering time period is set equal to or longer than the predetermined time period while the engine speed is within the high engine speed range equal to or greater than the predetermined engine speed. Thus, in the low engine speed range including engine speeds for cranking through a manual starting operation, the primary powering amount is reduced, and therefore relatively low secondary voltage is used to actuate a spark plug. However, since the compression pressure in the engine is relatively low, even the relatively low secondary voltage can easily actuate the spark plug. Furthermore, since the primary powering time period is relatively short, power consumption of the primary winding is small. Thus, the power outputted from the generator is sufficient to actuate the spark plug and start the engine. Hence, the ignition control circuit is actuated well and securely. In other words, the spark plug securely generates an electric spark, thereby making it possible to easily perform complete combustion in the engine and start the engine. After the engine is started, the engine may enter the high engine speed range, in which case the primary powering time period is controlled to or above a predetermined time period. As a result, the secondary voltage is increased. Thus, in the high engine speed range, too, where the compression pressure in the engine is increased, the spark plug is securely actuated, thereby making it possible to achieve a good high rotation state. Accordingly, ignition of the battery-less engine can be performed securely from a state where the engine is started via a manual starting operation to a state where the engine is in the high engine speed range, without particularly increasing the capacity of a magneto coil of the generator.

According to a second aspect of the present invention, there is proposed a method for starting and operating a battery-less engine, said engine being provided with a transistor-type ignition control circuit that includes a manual starting device, said ignition control circuit being actuated using an output of a generator driven by the engine, and wherein a primary winding of an ignition coil is powered from the ignition control circuit, comprising the steps of: determining a speed of the engine; setting a primary powering time period for powering the primary winding from the ignition control circuit to a value that is less than a predetermined time period when the engine is operating in a low engine speed range, said low engine speed range being below a predetermined engine speed; and, setting the primary powering time period for powering the primary winding from the ignition control circuit to a value that is at least equal to the predetermined time period when the engine speed is operating in a high engine speed range, said high engine speed range being equal to or greater than said predetermined engine speed.

The above and other objects, characteristics and advantages of the present invention will be clear from detailed descriptions of the preferred embodiment which will be provided below while referring to the attached drawings.

DESCRIPTION OF THE PREFERRED EMBODIMENT

Hereinbelow, an embodiment of the present invention will be described with reference to the accompanying drawings.

Figure 1:
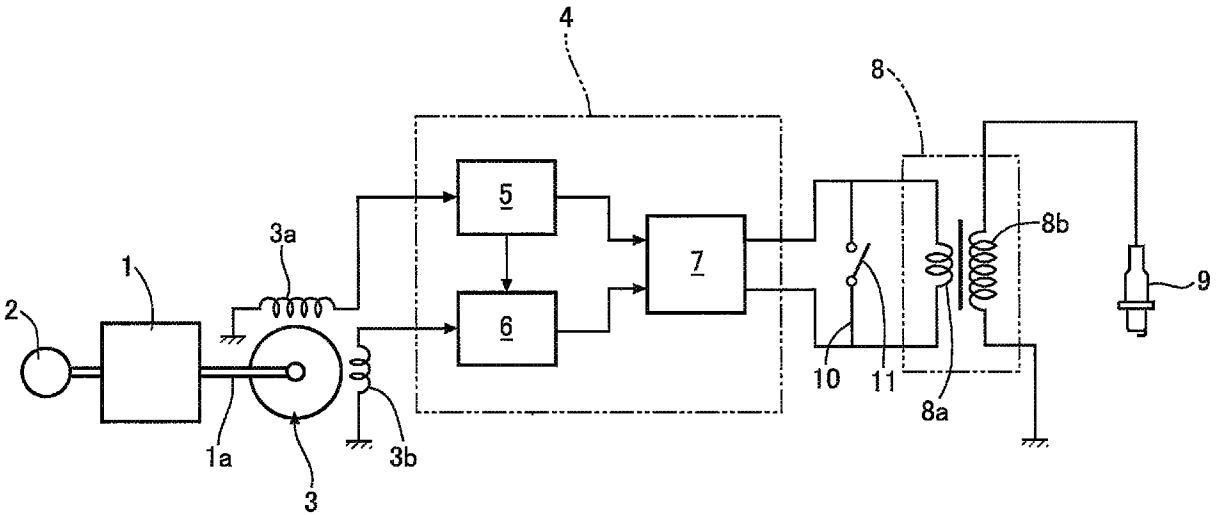
FIG. 1 is a circuit diagram of an ignition device for a battery-less engine according to an embodiment of the present invention.

In FIG. 1, reference numeral 1 denotes an engine for a work machine such as a pump, a string trimmer, a small cultivator, or the like, which is battery-less, i.e. equipped with no battery. The engine 1 includes a recoil starter 2 as a manual starting device. A crankshaft 1*a* of the engine 1 is directly connected to and drives a generator 3. The generator 3 includes a magneto coil 3*a* and a pulser coil 3*b*, and an electronic control unit 4 is connected to them.

The electronic control unit 4 includes a power supply circuit 5, a pulse processing circuit 6, and a transistor-type ignition control circuit 7. The power supply circuit 5 converts alternating-current output of the magneto coil 3*a* into direct-current output and adjusts it. The pulse processing circuit 6 is supplied with power from the power supply circuit 5 and adjusts each output pulse of the pulser coil 3*b* into a predetermined signal waveform. Based on an output signal of the pulse processing circuit 6, the ignition control circuit 7 powers a primary winding 8*a* of an ignition coil 8 by using the output of the power supply circuit 5. A spark plug 9 of the engine 1 is connected to a secondary winding 8*b* of the ignition coil 8.

More specifically, the ignition control circuit 7 determines an ignition timing, i.e. the timing to power the primary winding 8*a*, based upon the output signal of the pulse processing circuit 6. At the same time, the ignition control circuit 7 detects the engine speed of the engine 1 and controls and switches the time period of the powering of the primary winding to a value smaller than a predetermined value while the engine speed is within a predetermined low engine speed range including engine speeds for cranking, and to a value equal to or greater than the predetermined value while the engine speed is within a high engine speed range lying next to the low engine speed range.

A short circuit 10 connected between the ignition control circuit 7 and the primary winding 8*a* is provided with a normally-open engine stop switch 11. Thus, when the engine stop switch 11 is turned on, the output side of the ignition control circuit 7 is brought into a short-circuited state, thereby disabling the powering of the primary winding 8*a*. Hence, the engine operation can be stopped.

Next, operation of the electronic control unit 4 will be described through a flowchart in FIG. 2.

To start the engine 1, first, the engine stop switch 11 is turned off in step S1. Then, the recoil starter 2 is operated to crank the engine 1. The rotations of the crankshaft 1*a* by the operation of the recoil starter are transmitted to and drive the generator 3 and thereby actuate the power supply circuit 5. In step S2, the ignition control circuit 7 shifts to a standby state in response to input from the power supply circuit 5. Then, in step S3, the engine 1 is determined to be rotating. Such determination indicates that the engine 1 is battery-less.

Figure 3:
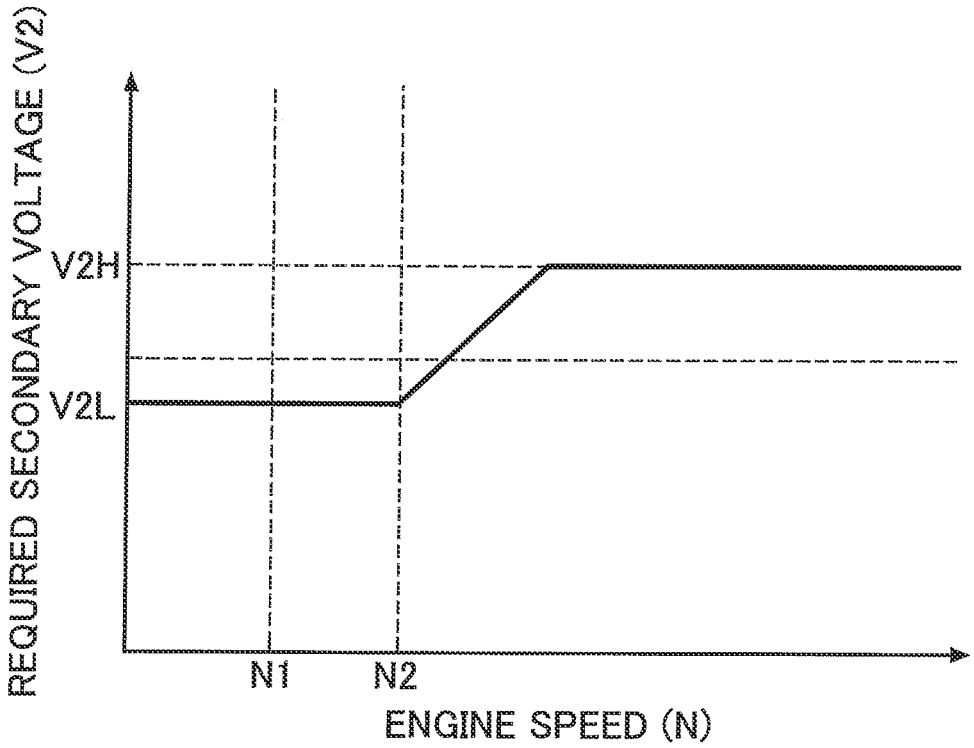
FIG. 3 is a diagram showing a correlation between engine speed and required second voltage.
Figure 4:
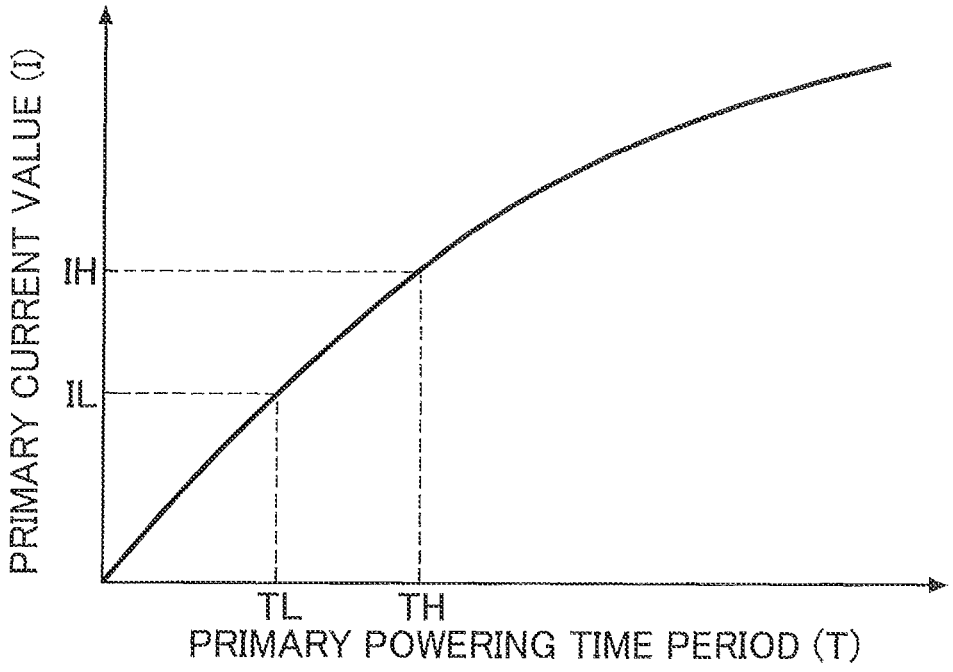
FIG. 4 is a diagram showing a correlation between a primary powering time period and a primary current value.
Figure 5:
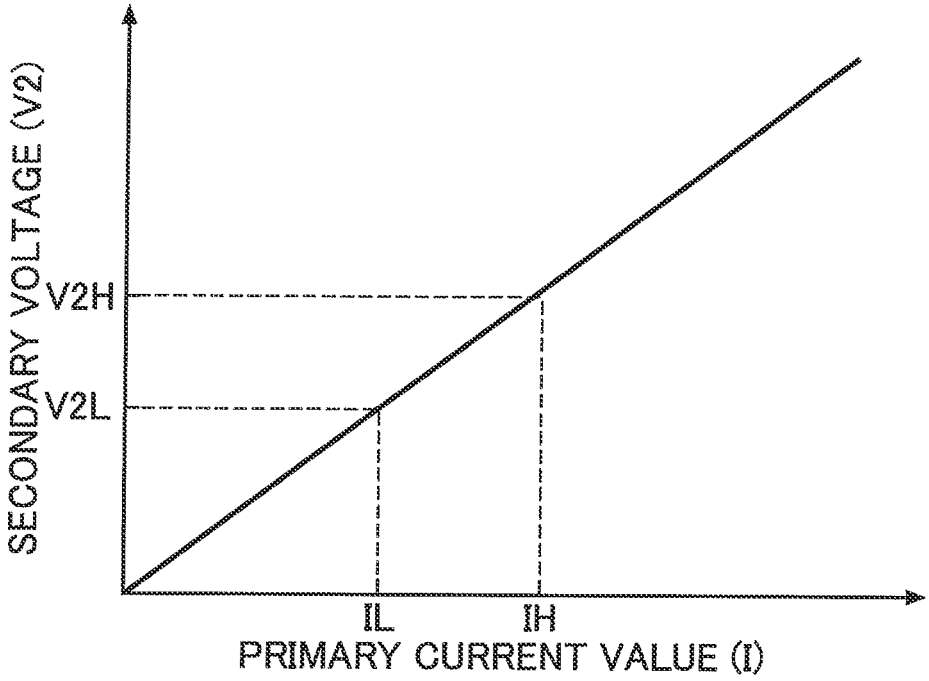
FIG. 5 is a diagram showing a correlation between the primary current value and the secondary voltage.

If the engine 1 is determined as battery-less in step S3, it is determined in step S4 whether an engine speed N is equal to or greater than an ignition-start engine speed N1 (see FIG. 3). In the case of YES, the ignition control circuit 7 controls a primary powering time period T for the primary winding 8*a* to a relatively short predetermined time period TL (see FIG. 4) in step S5. As a result, in step S6, secondary voltage V2 generated in the secondary winding 8*b* becomes a relatively low value V2L (see FIG. 5).

During starting or cranking of the engine 1, compression pressure is relatively low, so that even the relatively low secondary voltage V2L can easily actuate the spark plug 9. Furthermore, since the primary powering time period T is TL, which is relatively short, power consumption of the primary winding 8*a* is small. Thus, the power generated by the magneto coil 3*a* is sufficient to power the ignition circuit for engine startup. Hence, the power supply circuit 5, the pulse processing circuit 6, and the ignition control circuit 7 are actuated well and securely. Accordingly, the spark plug 9 securely generates an electric spark, thereby easily performing complete combustion in the engine 1 and completing the start of the engine 1.

After the engine is started, it is determined in step S7 whether the engine speed N is equal to or greater than a relatively high predetermined value N2 (see FIG. 3). In the case of YES, in step S8, the primary powering time period T is controlled to a relatively long predetermined time period TH (see FIG. 4). As a result, in step S9, the secondary voltage V2 becomes a relatively high value V2H (see FIG. 5). Thus, in the high engine speed range, too, where the compression pressure in the engine is increased, the spark plug 9 is securely actuated, thereby making it possible to achieve a good high rotation state.

Accordingly, ignition of the battery-less engine 1 can be performed securely not only when the engine 1 is started by operation of the recoil starter 2 but also when the engine 1 is operated in the high engine speed range, without particularly increasing the capacity of the magneto coil 3*a* of the generator 3.

To stop the operation of the engine 1, the engine stop switch 11 is turned on (step S10). As a result, the actuation of the spark plug 9 stops automatically (step S11), so that the engine 1 shifts to a stopped state (step S12).

Figure 2:
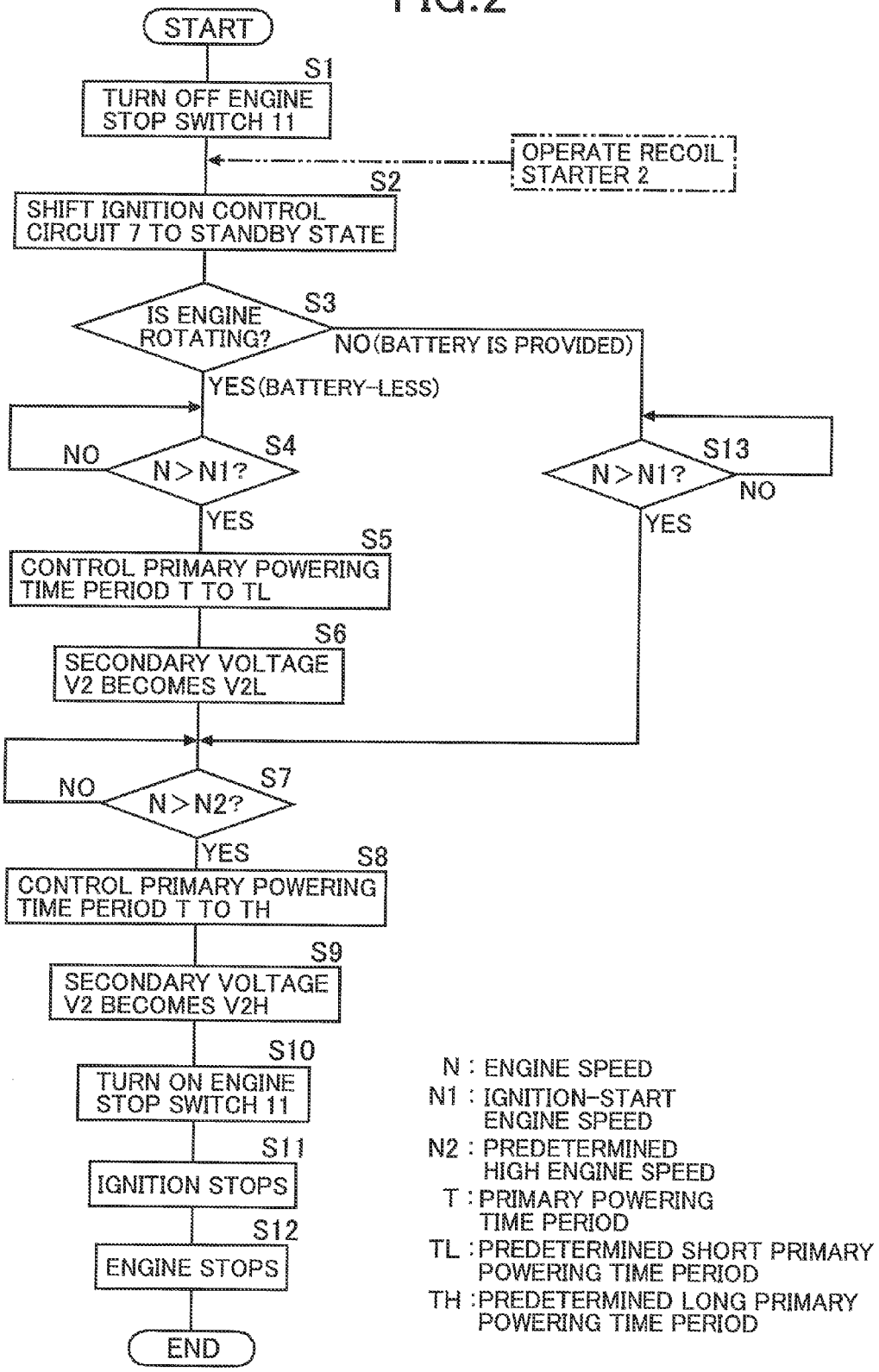
FIG. 2 is a flowchart for actuation of the ignition device.

Note that the flowchart in FIG. 2 is applicable to a starting device of an engine equipped with a battery. Specifically, when a battery is provided, when the engine stop switch 11 is turned off in step S1, the ignition control circuit 7 immediately shifts to a standby state by using power from the battery in step S2. Then, the process proceeds to step S3, where it is determined, before operating the recoil starter 2, whether or not the engine 1 is rotating. The engine 1 is determined as not rotating (NO), and the process then proceeds to step S13. Then, once the recoil starter 2 is operated, it is determined whether or not the engine speed N has exceeded the ignition-start engine speed N1. In the case of YES, the process immediately proceeds to step S7. The subsequent steps are the same as the battery-less case described above. Thus, in the engine equipped with a battery, the secondary voltage V2 is V2H, which is relatively high as compared to the beginning of the start of the engine.

The present invention is not limited to the foregoing embodiment, and various design changes can be made without departing from the scope of the gist of the present invention. For example, a kick starter may be employed instead of the recoil starter 2. Moreover, while the primary powering time period is switched between two levels based on two, high and low engine speed ranges in the foregoing embodiment, there may be three or more different engine speed ranges, and the primary powering time period may be switched between three or more levels corresponding to those ranges.

What is claimed is:

1. An ignition device for a battery-less engine configured such that a transistor-type ignition control circuit of an engine including a manual starting device is actuated by using output of a generator driven by the engine, and that a primary winding of an ignition coil is powered from the ignition control circuit, wherein the ignition control circuit is configured such that a primary powering time period for powering the primary winding from the ignition control circuit is set shorter than a predetermined time period while an engine speed of the engine is within a low engine speed range below a predetermined engine speed, whereas the primary powering time period is set equal to or longer than the predetermined time period while the engine speed of the engine is within a high engine speed range at and above the predetermined engine speed.

2. A method for starting and operating a battery-less engine, said engine being provided with a transistor-type ignition control circuit that includes a manual starting device, said ignition control circuit being actuated using an output of a generator driven by the engine, and wherein a primary winding of an ignition coil is powered from the ignition control circuit, comprising the steps of:

determining a speed of the engine;

setting a primary powering time period for powering the primary winding from the ignition control circuit to a value that is less than a predetermined time period when the engine is operating in a low engine speed range, said low engine speed range being below a predetermined engine speed; and, setting the primary powering time period for powering the primary winding from the ignition control circuit to a value that is at least equal to the predetermined time period when the engine speed is operating in a high engine speed range, said high engine speed range being equal to or greater than said predetermined engine speed.

3. The ignition device according to claim 1, wherein the ignition control circuit is configured to generate a first voltage in a secondary winding of the ignition coil when the primary powering time period for powering the primary winding from the ignition control circuit is set shorter than the predetermined time period, and to generate a second voltage in a secondary winding of the ignition coil when the primary powering time period is set equal to or longer than the predetermined time period, the second voltage being greater than the first voltage.

4. The method according to claim 2, wherein setting the primary powering time period for powering the primary winding from the ignition control circuit to the value that is less than the predetermined time period when the engine is operating in a low engine speed range generates a first voltage in a secondary winding of the ignition coil, and setting the primary powering time period for powering the primary winding from the ignition control circuit to the value that is at least equal to the predetermined time period when the engine speed is operating in the high engine speed range generates a second voltage in a secondary winding of the ignition coil, the secondary voltage being greater than the first voltage.

* * * * *